US007568690B2

(12) United States Patent
Kurokawa et al.

(10) Patent No.: US 7,568,690 B2
(45) Date of Patent: Aug. 4, 2009

(54) PAPER SUPPLY DEVICE AND IMAGE FORMING APPARATUS USING THE PAPER SUPPLY DEVICE

(75) Inventors: Yasuhiro Kurokawa, Saitama (JP); Satoru Shiraishi, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 391 days.

(21) Appl. No.: 11/405,574

(22) Filed: Apr. 18, 2006

(65) Prior Publication Data

US 2007/0057438 A1 Mar. 15, 2007

(30) Foreign Application Priority Data

Sep. 13, 2005 (JP) ..... 2005-265166

(51) Int. Cl.
*B65H 3/44* (2006.01)

(52) U.S. Cl. ..... 271/9.09; 271/9.01; 271/9.12; 271/9.13; 399/392; 399/124

(58) Field of Classification Search ..... 271/162, 271/164, 167, 9.12, 9.09, 9.11, 9.13, 127; 399/363, 369, 391, 392, 124
See application file for complete search history.

(56) References Cited

U.S. PATENT DOCUMENTS 5,213,427 A * 5/1993 Grosse et al. ..... 400/680
5,996,995 A * 12/1999 Kim et al. ..... 271/303
6,543,758 B2 * 4/2003 Imura et al. ..... 271/9.12
7,451,972 B2 * 11/2008 Fukada et al. ..... 271/9.09
2001/0028144 A1 * 10/2001 Imura et al. ..... 271/114

FOREIGN PATENT DOCUMENTS

JP 2001-225973 A 8/2001
JP 2005-112476 A 4/2005

* cited by examiner

*Primary Examiner*—Kaitlin S Joerger
(74) *Attorney, Agent, or Firm*—Sughrue Mion, PLLC

(57) ABSTRACT

A paper supply device includes: a paper supply cassette that is loaded into an image forming apparatus body, such that the paper supply cassette can be freely pulled out, and is disposed with a first sheet housing for supplying sheets to an image forming section of the image forming apparatus body; and a second sheet supply mechanism that is disposed in the paper supply cassette and is for supplying, to the image forming section of the image forming apparatus body, sheets housed in a second sheet housing different from the first sheet housing, wherein a recessed portion, through which paper supplying means that is disposed in the image forming apparatus body and supplies sheets to the image forming apparatus body from the second sheet housing passes when the paper supply cassette is loaded into and unloaded from the image forming apparatus body, is formed in the paper supply cassette.

20 Claims, 6 Drawing Sheets

PAPER SUPPLY DEVICE AND IMAGE FORMING APPARATUS USING THE PAPER SUPPLY DEVICE

CROSS-REFERENCE TO RELATED APPLICATION

This application claims priority under 35 USC 119 from Japanese Patent Application No. 2005-265166, the disclosure of which is incorporated by reference herein.

BACKGROUND OF THE INVENTION

1. Field of the Invention

The present invention relates to a paper supply device and an image forming apparatus using the paper supply device, and more particularly to a paper supply device that switches between plural types of sheets for use thereof and an image forming apparatus using the paper supply device.

2. Description of the Related Art

Ordinarily, in printers and the like, sheets on which an image is to be formed are housed in a cassette or magazine that is loaded into an apparatus body such that the cassette or magazine can be freely pulled out. The sheets are removed one sheet at a time by a feeding mechanism disposed in the apparatus body and fed to an image forming section, where image formation is conducted.

With respect thereto, image forming apparatus have been devised which are disposed with a tray that is exposed to the outside of the apparatus body and is for manually feeding the paper. That is, when the use of plural types of sheets is required of the image forming apparatus, the image forming apparatus includes a paper supply device disposed separately from the aforementioned cassette or magazine. The paper supply device includes: a sheet housing in which are stacked and which houses plural types of sheets; and feeding means for feeding, to the image forming section within the image forming apparatus, the sheets stacked and housed in the sheet housing.

For example, a paper supply cassette has been proposed where a second sheet feeding device is disposed on the end portion at the pullout side of a cassette that is loaded into the apparatus body such that the cassette can be freely pulled out. The second sheet feeding device includes: a second sheet housing separate from the sheet housing of the cassette; and feeding means that feeds the sheets housed in the second sheet housing to the image forming section (e.g., see Japanese Patent Application Publication (JP-A) No. 2001-225973).

However, when feeding means is attached to a cassette that can be freely pulled out as described above, it is necessary to dispose, in the cassette, drive means for driving paper supplying means, or to dispose, in the apparatus body, the drive means for driving the paper supplying means and to dispose, in the cassette and the apparatus body, drive coupling means for transmitting the driving force of the drive means to the paper supplying means, which results in an increase in the cost of the cassette and complication of the apparatus.

Further, because the paper supply cassette is frequently loaded and unloaded by a user, the weight of the paper supply cassette increases and its operability becomes poor when the drive means is disposed in the cassette, and there is the potential for malfunction when the drive means is disposed in the apparatus body.

An image forming apparatus has also been proposed which includes: a paper supply cassette that has a first sheet housing and is configured such that the paper supply cassette can be freely loaded into and unloaded from the image forming apparatus; and a second sheet housing disposed separately from the paper supply cassette. The paper supply cassette can itself be loaded into and unloaded from the image forming apparatus, and the second sheet housing can be pulled out together with the paper supply cassette while leaving in the apparatus body a paper supply roll that conveys the sheets housed in the second sheet housing (e.g., see JP-A No. 11-343037).

However, in this configuration, because the paper supply cassette and the second sheet housing are disposed separately, it is necessary to dispose in the image forming apparatus a mechanism for loading and unloading just the paper supply cassette itself and a mechanism for loading and unloading the second sheet housing together with the paper supply cassette. Thus, not only does the structure become complicated, but the apparatus itself also becomes large.

Further, when just the paper supply cassette itself is loaded and unloaded, and when the paper supply cassette and the second sheet housing are together loaded and unloaded, the position of the paper supply roll cannot be sufficiently lowered because the paper supply roll becomes an obstacle, the height of the paper supply device increases, and it is difficult to make the overall apparatus compact.

SUMMARY OF THE INVENTION

In consideration of these circumstances, the present invention provides a paper supply device that is disposed with plural sheet housings, has a simple configuration, and is kept low and made compact, and an image forming apparatus disposed with the paper supply device.

In a first aspect of the invention, a paper supply device comprises: a paper supply cassette that is loaded into an image forming apparatus body, such that the paper supply cassette can be freely pulled out, and is disposed with a first sheet housing for supplying sheets to an image forming section of the image forming apparatus body; and a second sheet supply mechanism that is disposed in the paper supply cassette and is for supplying, to the image forming section of the image forming apparatus body, sheets housed in a second sheet housing different from the first sheet housing, wherein a recessed portion, through which paper supplying means that is disposed in the image forming apparatus body and supplies sheets to the image forming apparatus body from the second sheet housing passes when the paper supply cassette is loaded into and unloaded from the image forming apparatus body, is formed in the paper supply cassette.

According to the configuration of this aspect, the configuration of the drive system becomes simple because the paper supplying means is fixedly disposed in the image forming apparatus body (or because it is not necessary for the paper supplying means to be retracted) when the cassette is loaded into and unloaded from the image forming apparatus body. Further, because the recessed portion is disposed in the paper supply cassette, the paper supplying means can be disposed near the paper supply cassette, and the apparatus does not become large.

In a second aspect of the invention, the paper supply device based on the first aspect further comprises a guide member that is disposed in the recessed portion and guides a leading end of a sheet that the paper supplying means conveys from the second sheet housing, wherein the guide member contacts the paper supplying means and is retracted when the paper supply cassette is loaded into and unloaded from the image forming apparatus body.

According to the configuration of this aspect, a situation is prevented where the sheet fed from the paper supplying means interferes with the sheet guide in the apparatus becomes jammed, so that even if the paper supplying means is lowered and disposed close to the second sheet housing, the guide member does not become an obstacle when the cassette is pulled out.

In a third aspect of the invention, the paper supply device based on the first aspect further comprises a separation member that separates the sheets housed in the second sheet housing, wherein the separation member and the guide member are integrally disposed.

According to the configuration of this aspect, even if the guide member is disposed in the vicinity of the separation member, the guide member does not hinder the maintenance and replacement of the separation member.

In a fourth aspect of the invention, the guide member based on the second or third aspect is supported such that it is swingable.

According to the configuration of this aspect, the surface of the guide member contacting the paper can always be maintained parallel to the paper conveyance surface.

In a fifth aspect of the invention, the guide member based on the fourth aspect is disposed high in a feeding direction and supported such that it is swingable around a shaft disposed at a pullout side of the paper supply cassette.

According to the configuration of this aspect, even if the guide member is disposed high in the feeding direction such that the leading end of the paper does not interfere with the downstream sheet guide, the guide member does not become caught when the cassette is loaded into and unloaded from the image forming apparatus body, and operability is improved.

In a sixth aspect of the invention, when the paper supply cassette based on any of the second to fifth aspects is loaded into and unloaded from the image forming apparatus body, the guide member contacts idle rollers pivotably disposed coaxially with the paper supplying means and is retracted.

According to the configuration of this aspect, there is no potential for the paper supply roll to damage the guide member because the rubber portion of the paper supply roll does not directly contact the guide member. Further, the guide member can be smoothly retracted.

In a seventh aspect of the invention, the guide member based on any of the second to sixth aspects is configured such that its surface contacting the sheet protrudes from a sheet conveyance surface toward the paper supplying means.

According to the configuration of this aspect, the paper can be prevented from becoming jammed because the paper being conveyed is pressed by the paper supply roll and bends.

In an eighth aspect of the invention, an image forming apparatus is disposed with the paper supply device based on any of the first to seventh aspects.

According to the configuration of this aspect, an image forming apparatus can be provided which is disposed with plural sheet housings and whose apparatus body is made compact.

According to the above-described configurations, the present invention can provide a paper supply device that is disposed with plural sheet housings, has a simple configuration, and is kept low and made compact, and an image forming apparatus disposed with the paper supply device.

BRIEF DESCRIPTION OF THE DRAWINGS

Embodiments of the present invention will be described below with reference to the accompanying drawings, wherein.

DETAILED DESCRIPTION OF THE INVENTION

Figure 1:
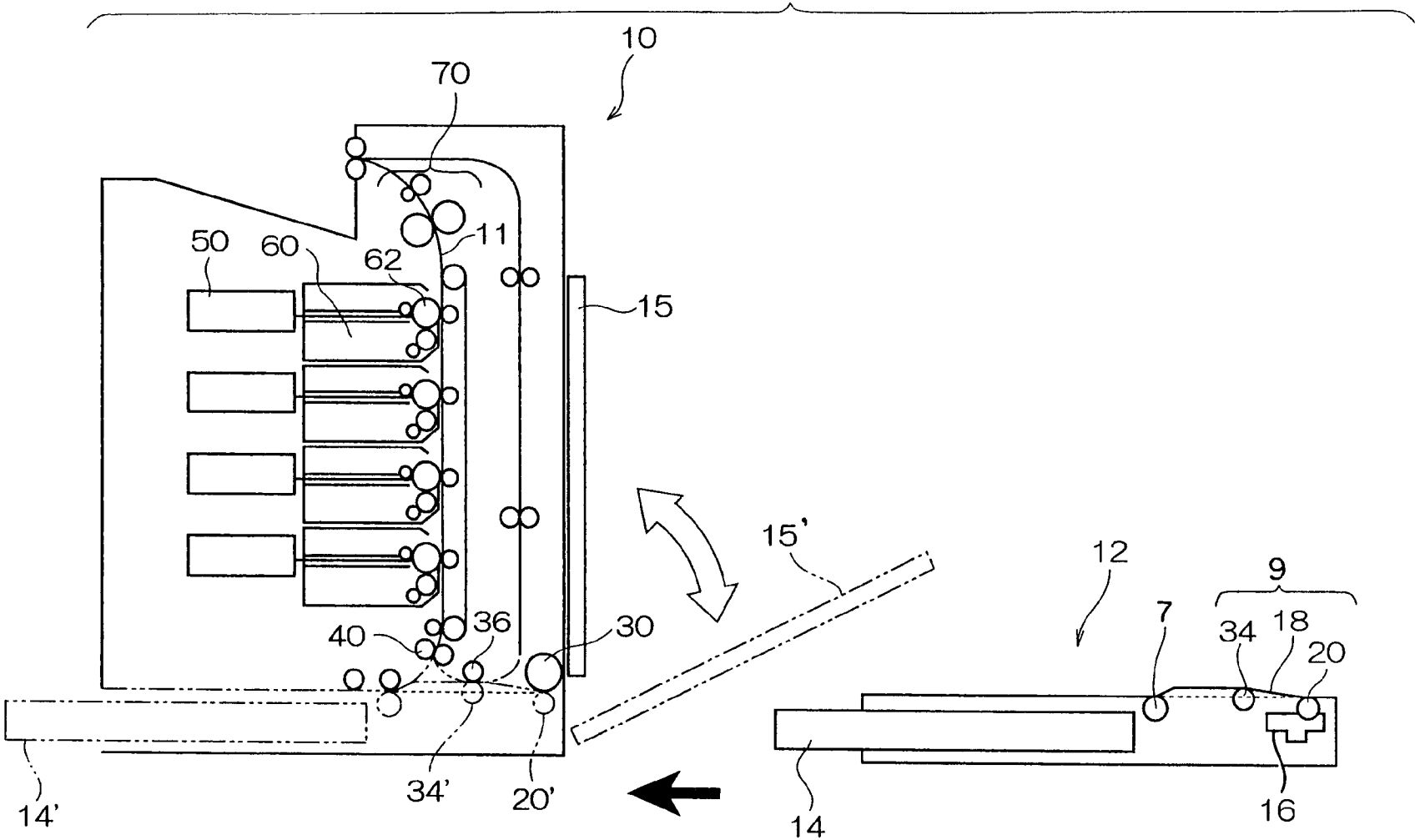
FIG. 1 is a diagram showing the configuration of an image forming apparatus pertaining to a first embodiment of the invention.

FIG. 1 shows the configuration of an image forming apparatus 10 pertaining to a first embodiment of the invention.

As shown in FIG. 1, the image forming apparatus 10 is an electrophotographic image forming apparatus that forms an image by conducting image exposure with raster output scanners 50 to form latent images on photoconductors 62, developing the latent images formed on the photoconductors 62 with toners inside developers 60 to form toner images, transferring the toner images to a sheet conveyed on a conveyance path 11, and fixing the toner image to the sheet with a fixer 70.

A sheet housing 14 is disposed in a cassette 12 that is loaded into the image forming apparatus 10, and sheets on which image formation is to be conducted are housed in the sheet housing 14. When the cassette 12 is loaded into the apparatus body as indicated by the black arrow in FIG. 1, the sheets inside the sheet housing 14 are conveyed in order, beginning with the uppermost sheet, to the apparatus body by a first sheet feeding mechanism 7, and image formation processing is conducted.

However, when a user wishes to switch between and use sheets of plural types and plural sizes, there is the drawback that the overall apparatus becomes large and expensive when plural cassettes 12 are housed inside the apparatus. This drawback can be eliminated by disposing a sheet housing 15 separately from the sheet housing 14 of the cassette 12, so that sheets of plural types and sizes can be switched between and processed.

That is, sheets of plural types and sizes can be conveyed by forming, in the cassette 12, a sheet conveyance path with a second sheet feeding mechanism 9 separately from a sheet conveyance path that the first sheet feeding mechanism 7 forms in the sheet housing 14 of the cassette 12.

Figure 2:
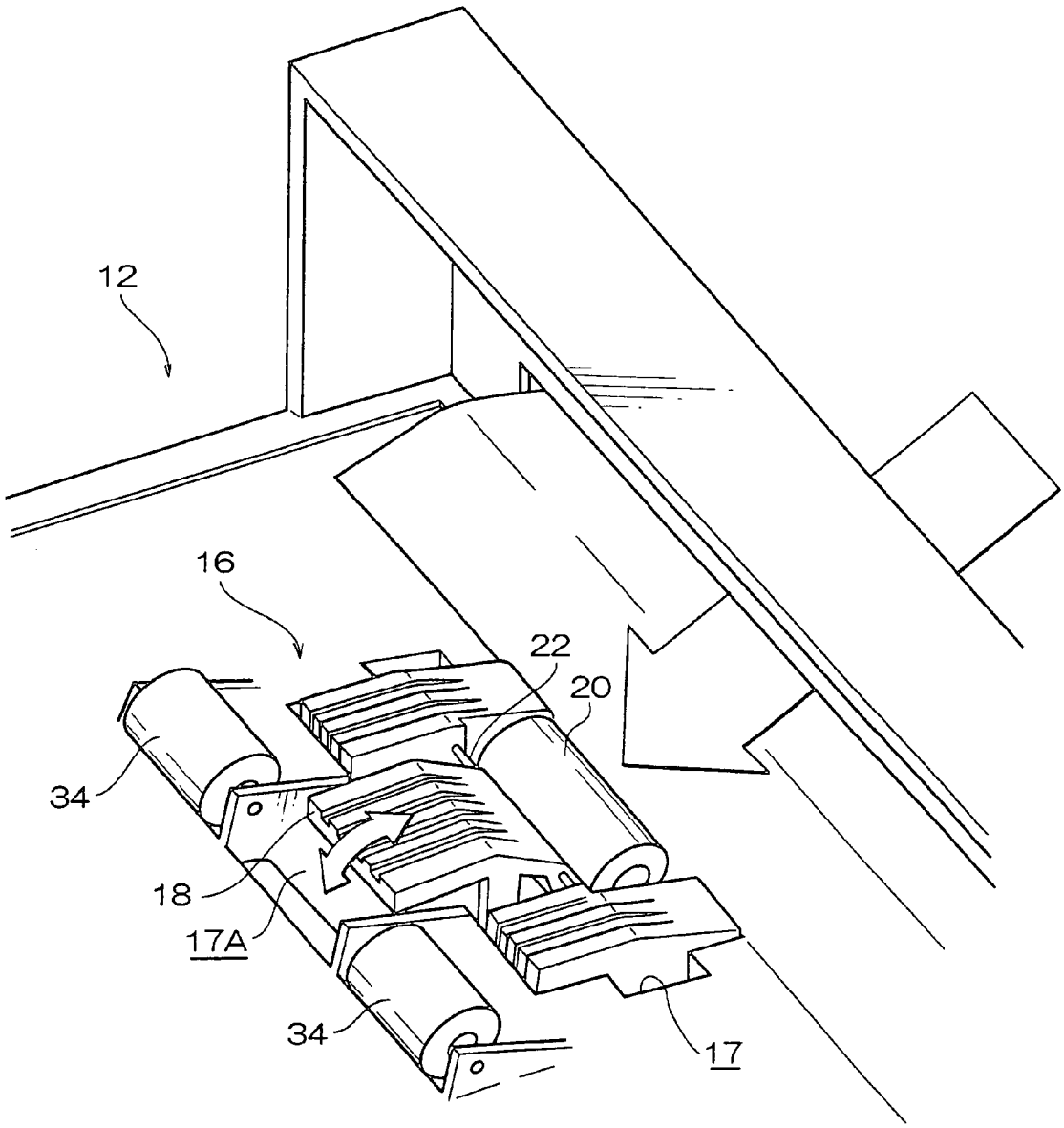
FIG. 2 is a diagram showing a paper supply device pertaining to the first embodiment of the invention.
Figure 3A:
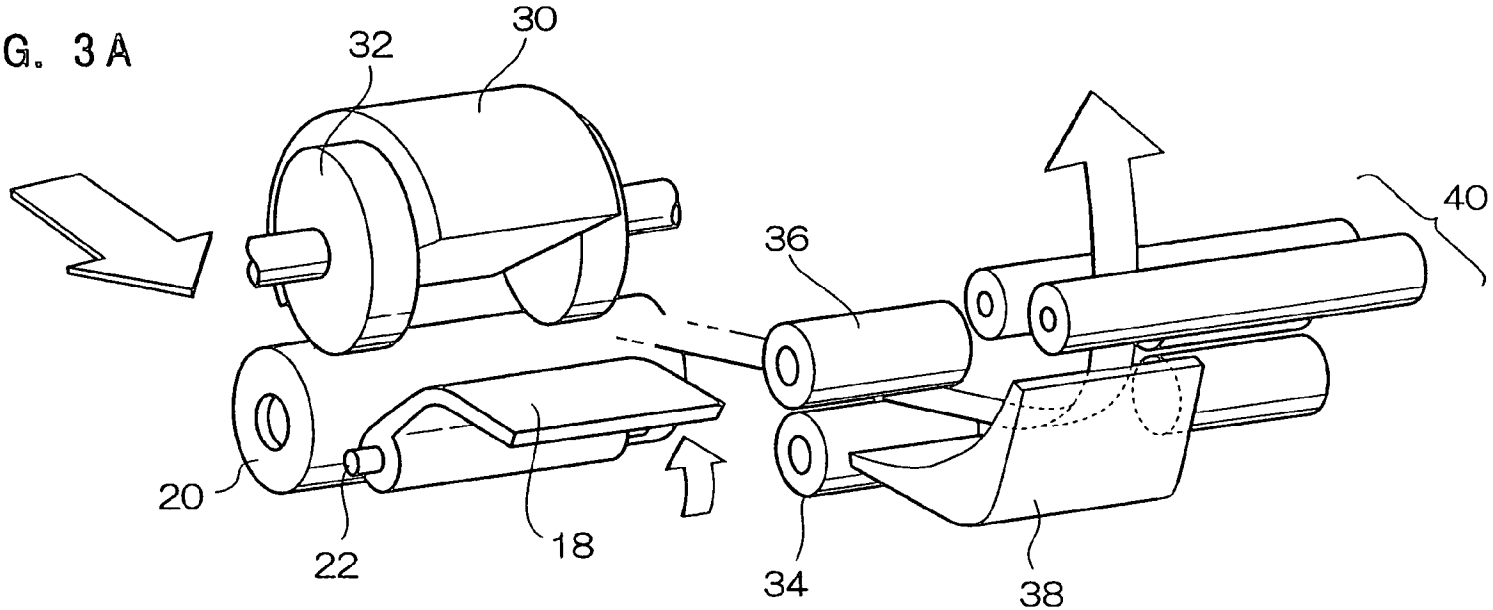
FIGS. 3A and 3B are diagrams showing the paper supply device pertaining to the first embodiment of the invention.
Figure 3B:
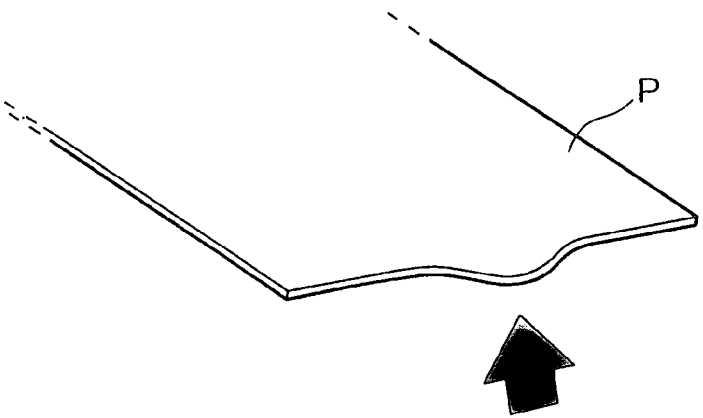

FIG. 2 and FIGS. 3A and 3B show the cassette 12 and a conveyance section pertaining to the first embodiment of the invention.

As shown in FIG. 1, by disposing the sheet housing 15 in the apparatus body separately from the sheet housing 14 of the cassette 12, and switching between and processing sheets of plural types and sizes, the sheets can be conveyed as indicated by the white arrow from the pullout front side of the cassette 12 as shown in FIG. 2.

Just the uppermost sheet of the inserted sheets is conveyed by a separation roll 20 and fed to the inside of the apparatus by a paper supply roll 30. The conveyed sheet is guided to guide rolls 34 and 36, strikes a guide 38, and is guided to a conveyance roller pair 40.

The conveyance path from the conveyance roller pair 40 on is shared with the conveyance path of the sheets conveyed from the sheet housing 14. That is, as the sheet is conveyed along the conveyance path 11, the toner images on the photoconductors 62 of yellow, magenta, cyan, and black are transferred onto the sheet to form a full-color toner image. The full-color toner image is fixed to the sheet by the fixer 70, and then the sheet is discharged.

The paper supply roll 30 that conveys the sheets from the sheet housing 15 is a half-moon roll that includes a nip portion such as rubber on just part of its outer peripheral surface, and is configured to not interfere with the separation roll 20 when the cassette 12 is loaded into the image forming apparatus 10.

In this case, the paper supply roll 30 and the guide rolls 34 that convey the sheets in the sheet housing 15 to the apparatus body are disposed such that they are offset in the sheet width direction. Thus, the paper supply roll 30 and the guide rolls 34 do not interfere with each other when the cassette 12 is loaded into and unloaded from the image forming apparatus 10, so that the cassette 12 can be smoothly loaded into and unloaded from the image forming apparatus 10.

That is, as shown in FIG. 2, the guide rolls 34 and the paper supply roll 30 are disposed such that the paper supply roll passes through the center of the width direction—i.e., between the guide rolls 34. Thus, the guide rolls 34 do not interfere with the paper supply roll 30 as the guide rolls 34 reach the position of 34' when the cassette 12 is inserted, so that the cassette 12 can be smoothly loaded into and unloaded from the image forming apparatus 10.

However, as shown in FIGS. 3A and 3B, the paper supply roll 30 nips and feeds the sheet P in the vicinity of the width-direction center of the sheet P. Thus, there is the potential for the leading end of the sheet P to become recessed in the direction in which it is pressed by the paper supply roll 30 (in this case, downward) as represented by the black arrow in FIG. 3B, and for this recess in the sheet P to interfere with the guide rolls 34.

For this reason, a guide plate 18 is downstream of the paper supply roll 30 and the separation roll 20 in the conveyance direction to prevent the sheet P from becoming recessed. Thus, paper jams resulting from the sheet P colliding with the guide rolls 34 can be prevented.

In this case, if the position of the guide plate 18 is too low with respect to the conveyance surface, the effect of regulating the position of the leading end of the sheet P becomes poor. And if the position of the guide plate 18 is too high with respect to the conveyance surface, there is the potential for the guide plate 18 to interfere with the paper supply roll 30 when the cassette 12 is loaded into and unloaded from the image forming apparatus 10. For this reason, a shaft 22 is disposed at the pullout front side of the guide plate 18 (i.e., upstream in the conveyance direction) at a height where it does not interfere with the conveyance surface formed by the separation roll 20, and the guide plate 18 is supported such that it is pivotable around the shaft 22.

Thus, the guide plate 18 is maintained at a sufficient height with respect to the conveyance surface while the sheet P is conveyed, regulates the position of the leading end of the sheet P, and is supported such that it is pivotable around the shaft 22 when the cassette 12 is loaded into and unloaded from the image forming apparatus 10. For this reason, the guide plate 18 is retracted to a height where it does not interfere with the paper supply roll 30, such that there is no potential for the guide plate 18 to damage the paper supply roll 30.

In this case, it is necessary to dispose, below the guide plate 18, a recessed portion 17A in order for the guide plate 18 to be retracted when the cassette 12 is loaded into and unloaded from the image forming apparatus 10 (i.e., when the paper supply roll 30 passes the guide plate 18). When the paper supply roll 30 passes the guide plate 18 as the cassette 12 is loaded into and unloaded from the image forming apparatus 10, the guide plate 18 pivots downward around the shaft 22. Thus, there is no potential for the guide plate 18 to contact the paper contacting surface of the paper supply roll 30 and damage the paper supply roll 30.

Further, because the shaft 22 is disposed at the pullout front side of the guide plate 18 (i.e., upstream in the conveyance direction), the shaft 22 is in front when the cassette 12 is to be pulled out. Thus, force works in the direction where the paper supply roll 30 contacts and pushes down the guide plate 18. For this reason, a situation where the guide plate 18 becomes caught on the paper supply roll 30, such that the cassette 12 cannot be removed, can be avoided.

Figure 4A:
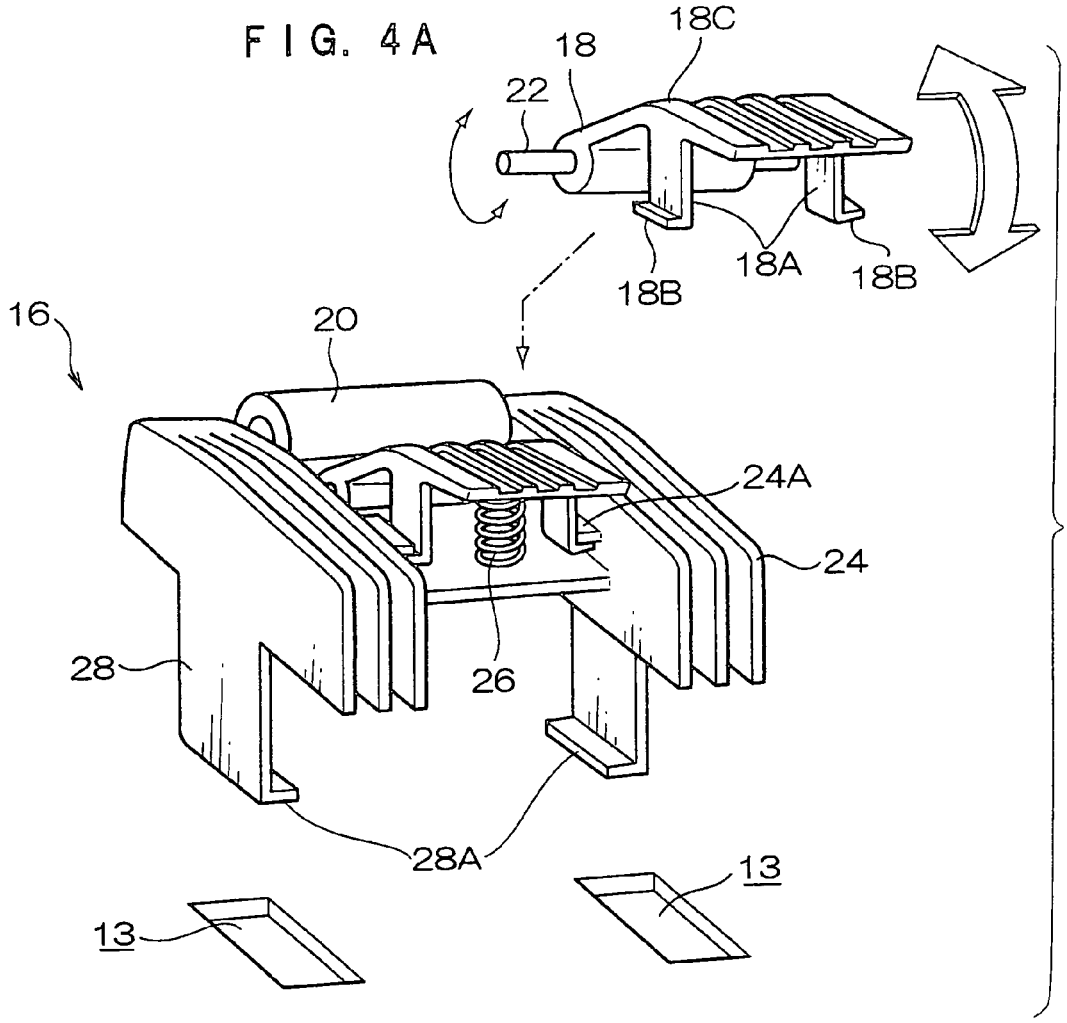
FIGS. 4A and 4B are diagrams showing a guide unit of the paper supply device pertaining to the first embodiment of the invention.
Figure 4B:
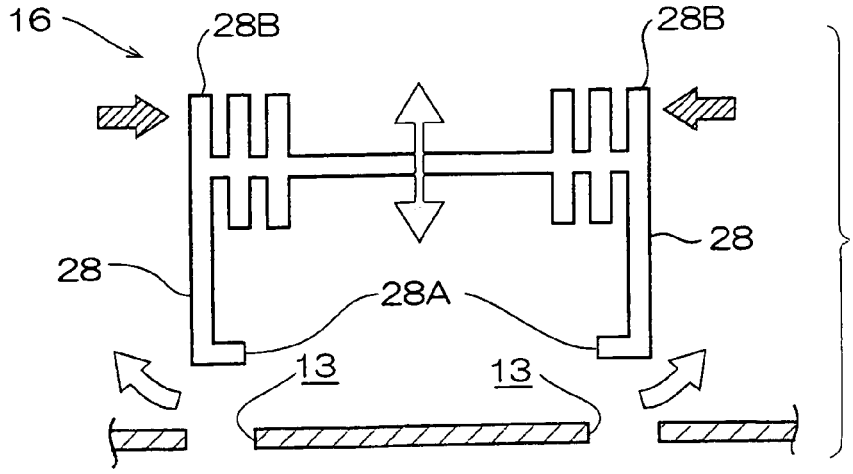

FIGS. 4A and 4B show a guide unit 16 pertaining to the first embodiment of the invention.

As shown in FIGS. 4A and 4B, the separation roll 20 and the guide plate 18 are assembled together and integrally disposed as the guide unit 16. Thus, even if the guide plate 18 is disposed in the vicinity of the separation roll 20, the presence of the guide plate 18 does not hinder the maintenance and replacement of the separation roll 20.

The guide unit 16 is configured such that it can be attached to and detached from the recessed portion 17 disposed in the cassette 12 from above when the assembled guide unit 16 is to be attached to the cassette 12, as shown in FIG. 2. Thus, the ease with which the guide unit 16 can be attached and detached is excellent in comparison to when the guide unit 16 is attached and detached from the side or from below, because the guide unit 16 can be attached and detached in a state where the cassette 12 has been pulled out from the apparatus body (i.e., the image forming apparatus 10).

The separation roll 20 and the guide plate 18 are disposed in the guide unit 16 from upstream in the conveyance direction. The guide plate 18 is configured to guide the sheet from below such that the leading end of the sheet passing the separation roll 20 does not become recessed in its underside.

As described above, if the position of the guide plate 18 is too low with respect to the conveyance surface, the effect of regulating the position of the leading end of the sheet P becomes poor. And if the position of the guide plate 18 is too high with respect to the conveyance surface, there is the potential for the guide plate 18 to interfere with the paper supply roll 30 when the cassette 12 is loaded into and unloaded from the image forming apparatus 10. For this reason, as shown in FIG. 4A, the shaft 22 is disposed at the pullout front side of the guide plate 18 (i.e., upstream in the conveyance direction) at a height where it does not interfere with the conveyance surface formed by the separation roll 20, and the guide plate 18 is supported such that it is pivotable around the shaft 22.

Thus, the guide plate 18 is maintained at a sufficient height with respect to the conveyance surface while the sheet P is conveyed, regulates the position of the leading end of the sheet P, and is supported such that it is pivotable around the shaft 22 when the cassette 12 is loaded into and unloaded from the image forming apparatus 10. For this reason, the guide plate 18 is retracted to a height where it does not interfere with the paper supply roll 30, such that there is no potential for the guide plate 18 to damage the paper supply roll 30.

Specifically, a spring 26 urges the guide plate 18 from below in the direction where the guide plate 18 pushes up the sheet (conveyance surface), arms 18A are disposed on the guide plate 18, and pawls 18B disposed on the leading ends of the arms 18A strike convex portions 24A disposed in the guide unit 16, whereby the position of the guide plate 18 is regulated such that the guide plate 18 does not become higher than a constant height.

Further, when the cassette 12 is loaded into and unloaded from the image forming apparatus 10, the guide plate 18 and the paper supply roll 30 do not directly contact each other; rather, the guide plate 18 contacts idle rollers 32 pivotably disposed on both sides of the paper supply roll 30 such that the guide plate 18 is retracted downward.

The idle rollers 32 are completely free with respect to the pivoting direction and have diameters that are larger than that of the paper supply roll 30. Rotational resistance does not arise even when the idle rollers 32 contact the guide plate 18. The idle rollers 32 push and cause the guide plate 18 to be retracted directly downward, and rotate and allow the guide plate 18 to pass at a place away from the surface of the paper supply roll 30. Thus, there is no potential for the rubber portion (i.e., the portion contacting the sheet P) of the paper supply roll 30 that has a half-moon roll structure to inadvertently contact and damage the guide plate 18.

Moreover, ribs 24 are disposed in the guide unit 16, and ribs 18C are disposed on the guide plate 18. The ribs 24 and the ribs 18C form the sheet conveyance surface and suppress frictional resistance when the sheet P is conveyed and guided.

The guide unit 16 is made into an assembly that can be integrally handled when it is attached to and detached from the cassette 12. As shown in FIGS. 4A and 4B, leg portions 28 disposed in the guide unit 16 are inserted into attachment holes 13 disposed in the cassette 12, and pawls 28A disposed on the leading ends of the leg portions 28 fit together with the attachment holes 13, whereby the guide unit 16 can be fixed to the cassette 12.

In this case, as shown in FIG. 4B, grip portions 28B are formed on both width-direction end portions of the upper portion of the guide unit 16. By gripping and pressing the grip portions 28B (as indicated by the arrows in FIG. 4B shaded with diagonal lines), the leading ends of the leg portions 28 widen, and the pawls 28B fit together with and become released from the attachment holes 13. Thus, the guide unit 16 can be easily and reliably attached to and detached from the cassette 12 (as indicated by the black arrow in FIG. 4B). Further, the upper surfaces of the grip portions 28B may also serve as the ribs 24 forming the conveyance surface.

Figure 5A:
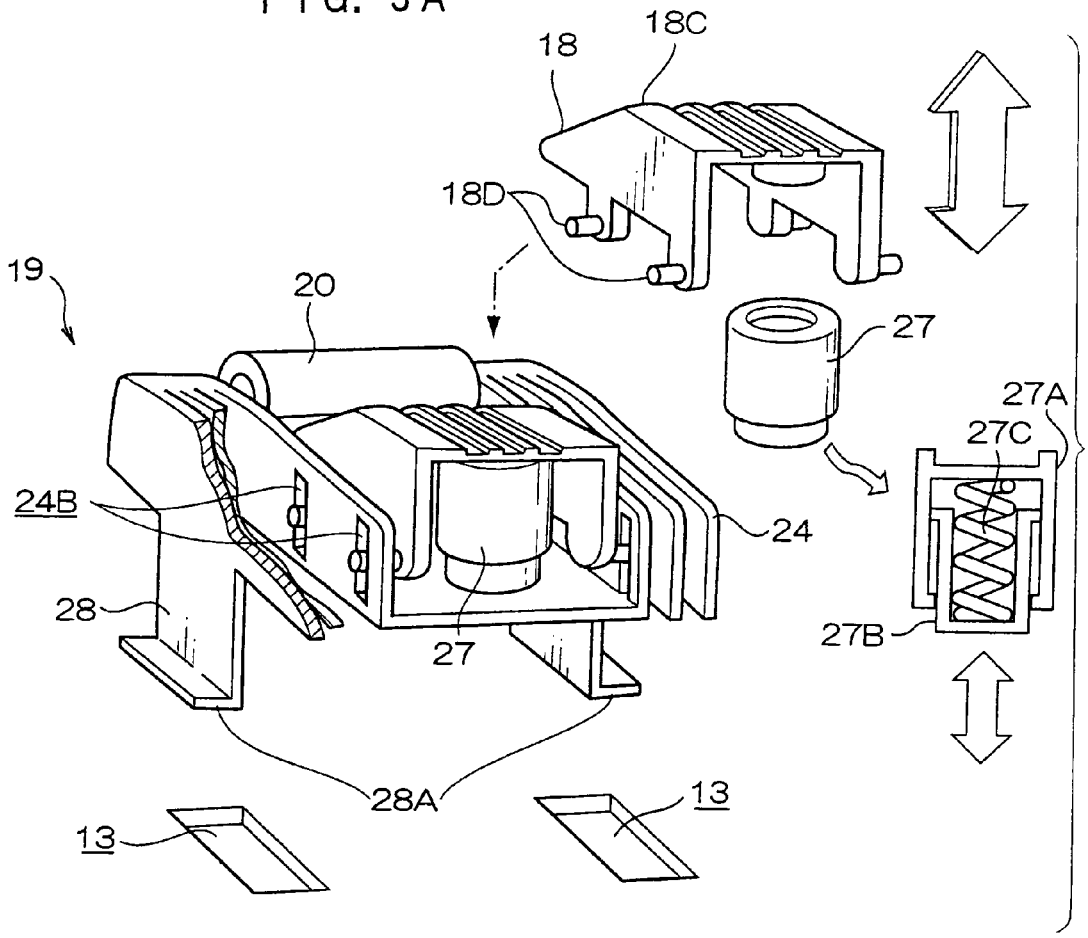
FIGS. 5A and 5B are diagrams showing a guide unit of a paper supply device pertaining to a second embodiment of the invention.
Figure 5B:
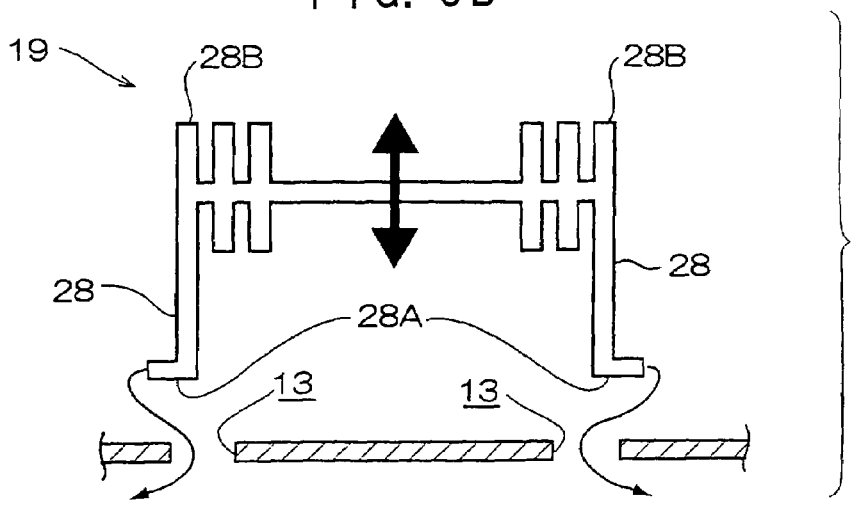

FIGS. 5A and 5B show a guide unit 19 pertaining to a second embodiment of the invention.

As shown in FIGS. 5A and 5B, the separation roll 20 and the guide plate 18 are assembled together and integrally disposed as the guide unit 19. Thus, even if the guide plate 18 is disposed in the vicinity of the separation roll 20, the presence of the guide plate 18 does not hinder the maintenance and replacement of the separation roll 20. In this respect, the guide unit 19 of the second embodiment is the same as the guide unit 16 of the first embodiment.

In the present embodiment, a spring 27 urges the guide plate 18 from below in the direction where the guide plate 18 pushes up the sheet (conveyance surface), protrusions 18D are disposed on both sides of the guide plate 18, and the protrusions 18D fit together with holes 24B disposed in the ribs 24. Thus, the protrusions 18D are movable up and down inside the ranges of the holes 24 and regulate the position of the guide plate 18 such that the guide plate 18 does not become higher than a constant height.

For this reason, in the present embodiment, in contrast to the first embodiment, the guide plate 18 does not pivot but contacts the idle rollers 32 and slides up and down (as indicated by the white arrow in FIG. 5A), whereby the guide plate 18 is prevented from interfering with the paper supply roll 30. Thus, there is no potential for the rubber portion (i.e., the portion contacting the sheet P) of the paper supply roll 30 that has a half-moon roll structure to inadvertently contact and damage the guide plate 18.

The spring 27 may be a simple coil spring or the like, but as shown in FIG. 5A, it may also comprise a coil spring 27 housed in an outer cylinder 27A and an inner cylinder 27B, so that it can be easily assembled and disassembled.

The second embodiment is also the same as the first embodiment in that the guide unit 19 can be fixed to the cassette 12 as a result of the pawls 28A disposed on the leading ends of the leg portions 28 fitting together with the attachment holes 13. However, as shown in FIGS. 5A and 5B, the pawls 28A may also be disposed on the outer sides, rather than on the inner sides, of the leg portions 28A. In this case, the pawls 28A come out of the attachment holes 13 as a result of the vicinities of the leading ends of the leg portions 28 being pressed from both sides, so that the guide unit 19 can be attached to and detached from the attachment holes 13.

Further, the attachment dimensions, with respect to the cassette 12, of the guide unit 16 pertaining to the first embodiment and the guide unit 19 pertaining to the second embodiment may be set such that they are equal, so that both can be appropriately replaced and used with respect to the same cassette 12 as needed.

Moreover, the ribs 24 of the guide unit 16 and the guide unit 19 may have a common structure, so that both can be appropriately replaced and used with respect to the common rib 24 portions by replacing just the guide plate 18A and the spring 26 or 27 as needed.

Figure 6A:
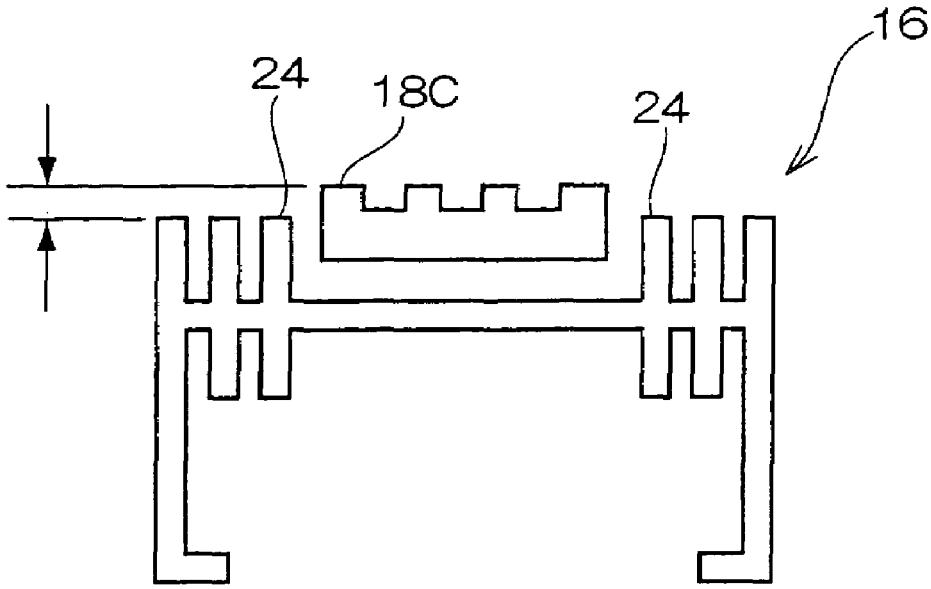
FIGS. 6A and 6B are diagrams showing the guide unit of the paper supply device pertaining to the invention.
Figure 6B:
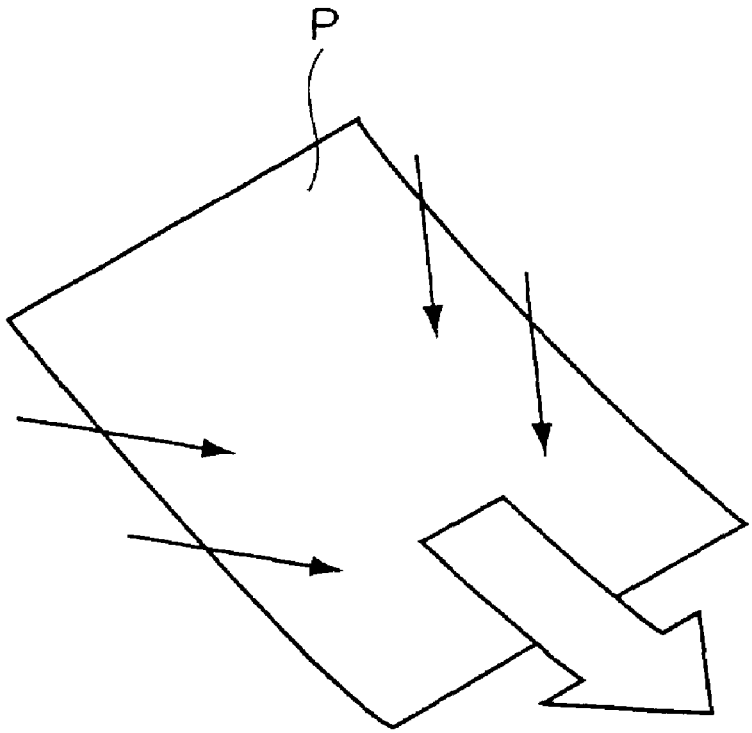

FIGS. 6A and 6B show the guide unit pertaining to the invention.

As shown in FIG. 6A, the guide unit may be configured such that the conveyance surface formed by the ribs 18C of the guide plate 18 are not even with, but rather higher than (i.e., in the direction where the guide plate 18 urges the sheet P toward the paper supply roll 30), the conveyance surface formed by the ribs 24 of the guide unit 16 or the guide unit 19.

Thus, the leading end of the sheet P is prevented from becoming recessed as described above in the direction where it is pressed against the paper supply roll 30 (in this case, from below), and paper jams resulting from the leading end of the sheet P interfering/colliding with the guide rolls 34 due to such a recess is prevented. Further, a situation can be prevented where (as has conventionally been the case) the paper supply roll 30 nips and conveys the sheet P just in the vicinity of the width-direction center of the sheet P, such that force pulls the sheet P toward its center from both width-direction ends as shown in FIG. 6B and causes the sheet P to become wrinkled.

Embodiments of the invention have been described above, but the present invention should not be construed as being limited in any way to these embodiments. The invention can be implemented in various modes in a range that does not depart from the gist of the invention.

That is, the paper supply device disposed with the plural sheet housings pertaining to the first and second embodiments of the invention is not limited to housing paper sheets, and in addition to image forming apparatus, is also applicable to cutters and coaters that convey paper-like sheets.

What is claimed is:

1. A paper supply device comprising:

a paper supply cassette that is loaded into an image forming apparatus body, such that the paper supply cassette can be freely pulled out, and is disposed with a first sheet housing for supplying sheets to an image forming section of the image forming apparatus body; and a second sheet supply mechanism that is disposed in the paper supply cassette and is for supplying, to the image forming section of the image forming apparatus body, sheets housed in a second sheet housing different from the first sheet housing, wherein a recessed portion, through which paper supplying means passes when the paper supply cassette is loaded into and unloaded from the image forming apparatus body, is formed in the paper supply cassette, wherein the paper supply means supplies sheets to the image forming apparatus body from the second sheet housing.

2. The paper supply device of claim 1, further comprising a guide member that is disposed in the recessed portion and guides a leading end of a sheet that the paper supplying means conveys from the second sheet housing, wherein the guide member contacts the paper supplying means and is retracted when the paper supply cassette is loaded into and unloaded from the image forming apparatus body.

3. The paper supply device of claim 2, further comprising a separation member that separates the sheets housed in the second sheet housing, wherein the separation member and the guide member are integrally disposed.

4. The paper supply device of claim 2, wherein the guide member is supported such that it is swingable.

5. The paper supply device of claim 4, wherein the guide member is disposed high in a feeding direction and supported such that it is swingable around a shaft disposed at a pullout side of the paper supply cassette.

6. The paper supply device of claim 2, wherein when the paper supply cassette is loaded into and unloaded from the image forming apparatus body, the guide member contacts idle rollers pivotably disposed coaxially with the paper supplying means and is retracted.

7. The paper supply device of claim 2, wherein the guide member is configured such that its surface contacting the sheet protrudes from a sheet conveyance surface toward the paper supplying means.

8. A paper supply device comprising:

a paper supply cassette that is loaded into an image forming apparatus body, such that the paper supply cassette can be freely loaded and unloaded, and is disposed with a first sheet housing that houses sheets;

a first sheet supply mechanism for supplying, to an image forming section of the image forming apparatus body, the sheets housed in the first sheet housing;

a second sheet supply mechanism that is disposed in the paper supply cassette and is for supplying, to the image forming section of the image forming apparatus body, sheets housed in a second sheet housing different from the first sheet housing; and paper supplying means that is disposed in the image forming apparatus body and works together with the second sheet supply mechanism to supply sheets to the image forming apparatus body from the second sheet housing, wherein part of the second sheet supply mechanism is configured to be retractable with respect to the paper supplying means such that the second sheet supply mechanism does not interfere with the paper supplying means when the paper supply cassette is loaded into and unloaded from the image forming apparatus body.

9. The paper supply device of claim 8, wherein the part of the second sheet supply mechanism configured to be retractable with respect to the paper supplying means is a guide member that guides a leading end of a sheet conveyed by the paper supplying means from the second sheet housing.

10. The paper supply device of claim 9, wherein the guide member is configured to contact the paper supplying means and be retracted when the paper supply cassette is loaded into and unloaded from the image forming apparatus body.

11. The paper supply device of claim 9, wherein the guide member is supported such that it is swingable.

12. The paper supply device of claim 11, wherein the guide member is configured to become higher proceeding downstream in a feeding direction, and is supported such that it is swingable around a shaft disposed at an edge portion at a pullout side of the paper supply cassette.

13. The paper supply device of claim 9, wherein when the paper supply cassette is loaded into and unloaded from the image forming apparatus body, the guide member contacts idle rollers pivotably disposed coaxially with the paper supplying means and is retracted.

14. The paper supply device of claim 9, wherein the second sheet supply mechanism further includes a separation member that separates the sheets housed in the second sheet housing, and the separation member and the guide member are integrally disposed.

15. The paper supply device of claim 9, wherein the guide member is configured such that its surface contacting the sheet protrudes from a sheet conveyance surface toward the paper supplying means.

16. An image forming apparatus disposed with the paper supply device of claim 1.

17. An image forming apparatus disposed with the paper supply device of claim 8.

18. A paper supply device comprising:

a paper supply cassette configured to be loaded into an image forming apparatus body such that the paper supply cassette can be freely pulled out and including a first sheet housing for supplying sheets to an image forming section of an image forming apparatus body; and a sheet supply mechanism that is disposed in the paper supply cassette and is for supplying, to the image forming section of the image forming apparatus body, sheets housed in a second sheet housing different from the first sheet housing, wherein the paper supply cassette includes a recessed portion through a portion of the sheet supply mechanism passes when the paper supply cassette is loaded into and unloaded from the image forming apparatus body.

19. The paper supply device of claim 18, wherein the portion of the sheet supply mechanism is a guide member that guides a leading end of a sheet conveyed from the second sheet housing.

20. The paper supply device of claim 19, wherein the guide member is configured to contact a paper supplying device inside the image forming apparatus body in a manner such that the guide member retracts when the paper supply cassette is loaded into the image forming apparatus body.

* * * * *